US007367854B2

(12) United States Patent
Arvidsson

(10) Patent No.: US 7,367,854 B2
(45) Date of Patent: May 6, 2008

(54) METHOD OF STEERING A BOAT WITH DOUBLE OUTBOARD DRIVES AND BOAT HAVING DOUBLE OUTBOARD DRIVES

(75) Inventor: Lennart Arvidsson, Kållered (SE)

(73) Assignee: AB Volvo, Gothenburg (SE)

( * ) Notice: Subject to any disclaimer, the term of this patent is extended or adjusted under 35 U.S.C. 154(b) by 23 days.

(21) Appl. No.: 11/579,742

(22) PCT Filed: May 28, 2004

(86) PCT No.: PCT/SE2004/000828

§ 371 (c)(1),
(2), (4) Date: Nov. 7, 2006

(87) PCT Pub. No.: WO2005/115834

PCT Pub. Date: Dec. 8, 2005

(65) Prior Publication Data

US 2007/0224893 A1 Sep. 27, 2007

(51) Int. Cl.
*B63H 23/00* (2006.01)

(52) U.S. Cl. ..... 440/1; 440/87

(58) Field of Classification Search ..... 440/1, 440/2, 84, 87; 60/702, 706
See application file for complete search history.

(56) References Cited

U.S. PATENT DOCUMENTS 4,822,307 A * 4/1989 Kanno ..... 440/1
4,938,721 A * 7/1990 Koike ..... 440/2
5,361,024 A 11/1994 Wiesner et al.
5,782,659 A * 7/1998 Motose ..... 440/1
6,150,928 A 11/2000 Murray
7,153,174 B2 * 12/2006 Takada et al. ..... 440/1
2002/0065169 A1 5/2002 Suzuki et al.
2003/0079668 A1 5/2003 Morvillo

* cited by examiner

*Primary Examiner*—Lars A. Olson
(74) *Attorney, Agent, or Firm*—Young & Thompson

(57) ABSTRACT

Boat with a hull with double engines which are controlled by a respective electronic engine control unit and are coupled to a respective outboard drive, which drives are driven by electric servomotors/electronic drive control units. The drive control units communicate with the engine control units and continuously monitor the steering function of the drives and together with the engine control units, upon detection of a steering fault in a control system, gradually to reduce the speed of the engine in question to idling, to activate an alarm, to reduce the throttle of the other engine, to disengage and lock in neutral position the gear of the failing drive, and to lock the drive in the current angular position. After acknowledgement from the driver, neutral lock is cancelled and a gear can be engaged. The associated engine can then be used with but limited to approximately half throttle.

20 Claims, 3 Drawing Sheets

Figure 1:
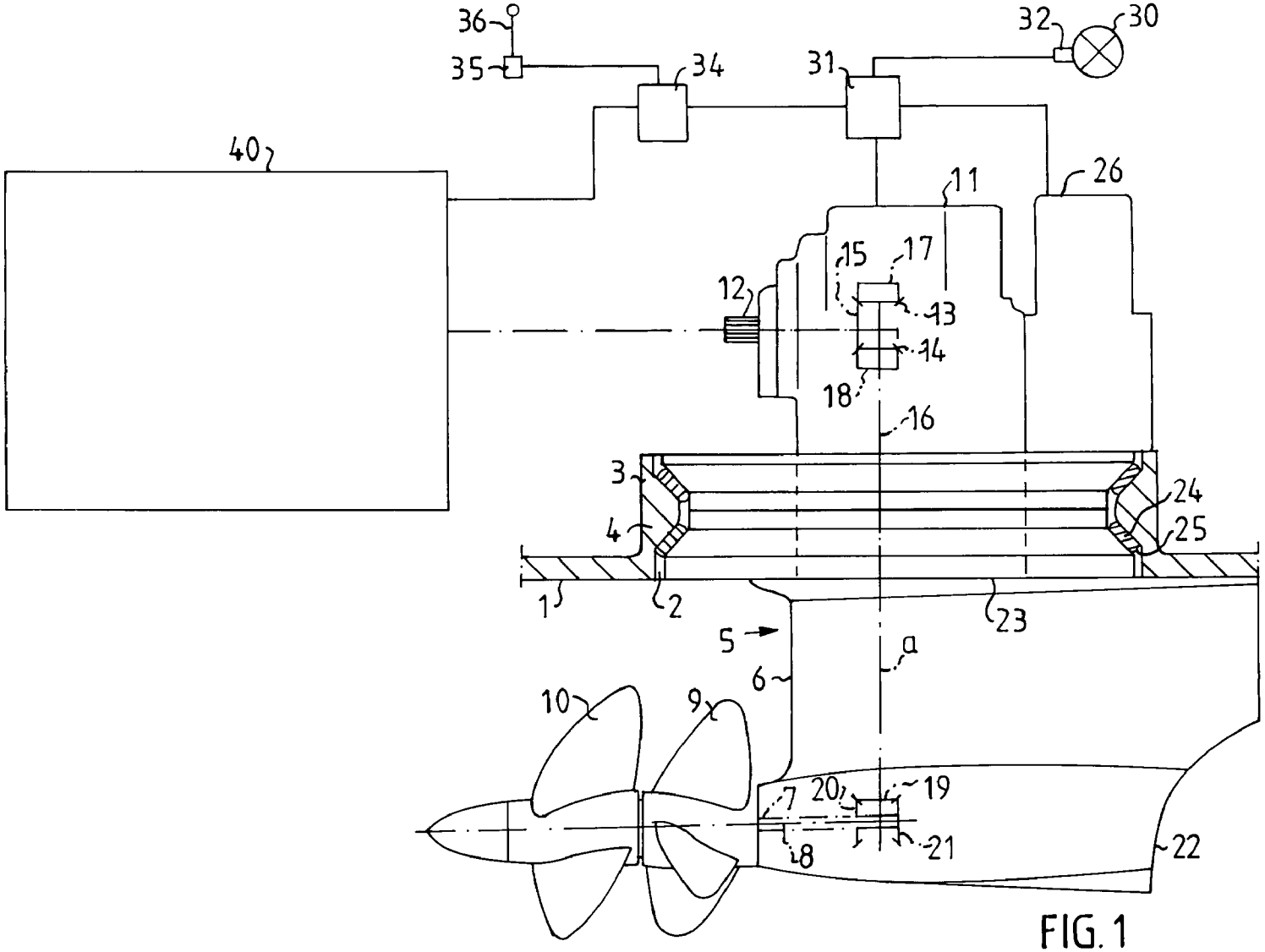

METHOD OF STEERING A BOAT WITH DOUBLE OUTBOARD DRIVES AND BOAT HAVING DOUBLE OUTBOARD DRIVES

The present invention relates to a method of regulating engine speed and steering in the event of fault detection in the control system in a boat with two engines, which are speed-controlled by electronic engine control means depending on signals from sensors which are coordinated with manually operable gear and throttle controls, and an outboard drive coupled to each engine, which has an underwater housing which is rotatable relative to the hull of the boat and in which at least one propeller shaft can be driven via an electrically operated transmission, with forward, neutral and reverse gear, arranged in a housing in the drive and the rotation of which is regulated by means of an electric servomotor controlled by an electronic control unit depending on signals from a sensor coordinated with manually operable steering means.

The invention also relates to a boat with a hull in which an outboard drive is mounted on each side of a central plane of the hull, each of which drives on the one hand is coupled to an internal combustion engine, which is speed-controlled by electronic engine control means depending on signals from sensors which are coordinated with manually operable gear and throttle controls, and on the other hand comprises an underwater housing which projects downwards from the outside of the hull and is mounted rotatably relative to the hull and in which at least one in the main horizontal propeller shaft is rotatably mounted and can be driven via an electrically operated transmission, with forward, neutral and reverse gear, arranged in a housing in the drive and the rotation of which is regulated by means of a control system which comprises an electronic control unit and an electric servomotor which is controlled by the control unit depending on signals from a sensor coordinated with manually operable steering means and communicating with the control unit.

In boats with electric control systems, which do not have a mechanical connection between the wheel of the boat and the rotatable underwater housing of the drives, it is important that the systems are designed with a view to maximum possible safety, so that an electrical fault cannot cause serious accidents or render continued travel with the boat impossible.

The object of the present invention is therefore to provide a method of, when steering a boat in the way indicated in the introduction, in the event of detection of a fault in the control system and without requiring the assistance of the driver of the boat, that is to say in principle before the driver has even noticed that a fault has occurred in the steering of one of the drives, automatically controlling engines and drives, so that the speed of the boat is reduced in a comfortable way at the same time as controlled steering is maintained, so that the boat can continue to be driven with maintained safety.

According to the invention, this is achieved by virtue of the fact that, in the event of detection of a fault in the control system of one drive during driving, the engine and drive control electronics automatically gradually reduce the engine speed from a speed within the higher speed range of the engine to a predetermined lower speed in at least the engine belonging to the drive with the control system in which the fault has been detected, activate an alarm for the driver, lock the drive with the control system in which the fault has been detected in the current steering position and limit the maximum permitted speed to a lower speed than the maximum speed in at least the engine belonging to the drive with the control system in which the fault has been detected after acknowledgement from the driver that the fault detection has been noted.

The speed of the engine belonging to the drive with the control system in which the fault has been detected is preferably first reduced by a gentle throttling-down to idling, when the associated drive is shifted to and locked in neutral position. The engine speed of the other engine is also suitably reduced by a gentle throttling-down to a predetermined speed higher than idling speed but lower than maximum speed, so that the boat continues forwards at a lower speed but with maintained steerability. The control system can be adapted so that, when the driver puts the gear and throttle control in neutral position, this is understood as an acknowledgement that the fault has been noted, the locking in neutral position and the speed limitation to idling then being cancelled.

As the risk of accidents in the event of steering failure is considerably greater at high speeds than at low speeds at the same time as high speeds are also more usual when driving straight ahead than when turning sharply, the combination of the locking of the drive steering in the current position and the reduction of the engine speed by a gentle throttling-down means that the driver is not rendered liable to surprises in the form of a sudden yaw or sharp braking. Irrespective of whether the boat is being driven straight ahead or is turning when the fault is detected, it continues at reduced speed on the course set or with the change in course initiated and can from then on be steered with perfectly satisfactory steerability by the other drive.

A boat with outboard drives of the kind indicated in the introduction, which can be steered in this way, is characterized according to the invention in that the control units communicate with the engine control means and are adapted so as continuously to monitor the steering function of the drives and together with the engine control means—in the event of detection of a steering fault in the control system of one of the drives—to initiate gradual reduction of the speed of at least the engine belonging to the drive with the control system in which the fault has been detected to a predetermined lower speed, to activate alarm means communicating with the control units, to lock the drive with the control system in which the fault has been detected in the current steering position and, after a signal from manually operable means, to limit the maximum permitted speed to a lower speed than the maximum speed in at least the engine belonging to the drive with the control system in which the fault has been detected.

Figure 2:
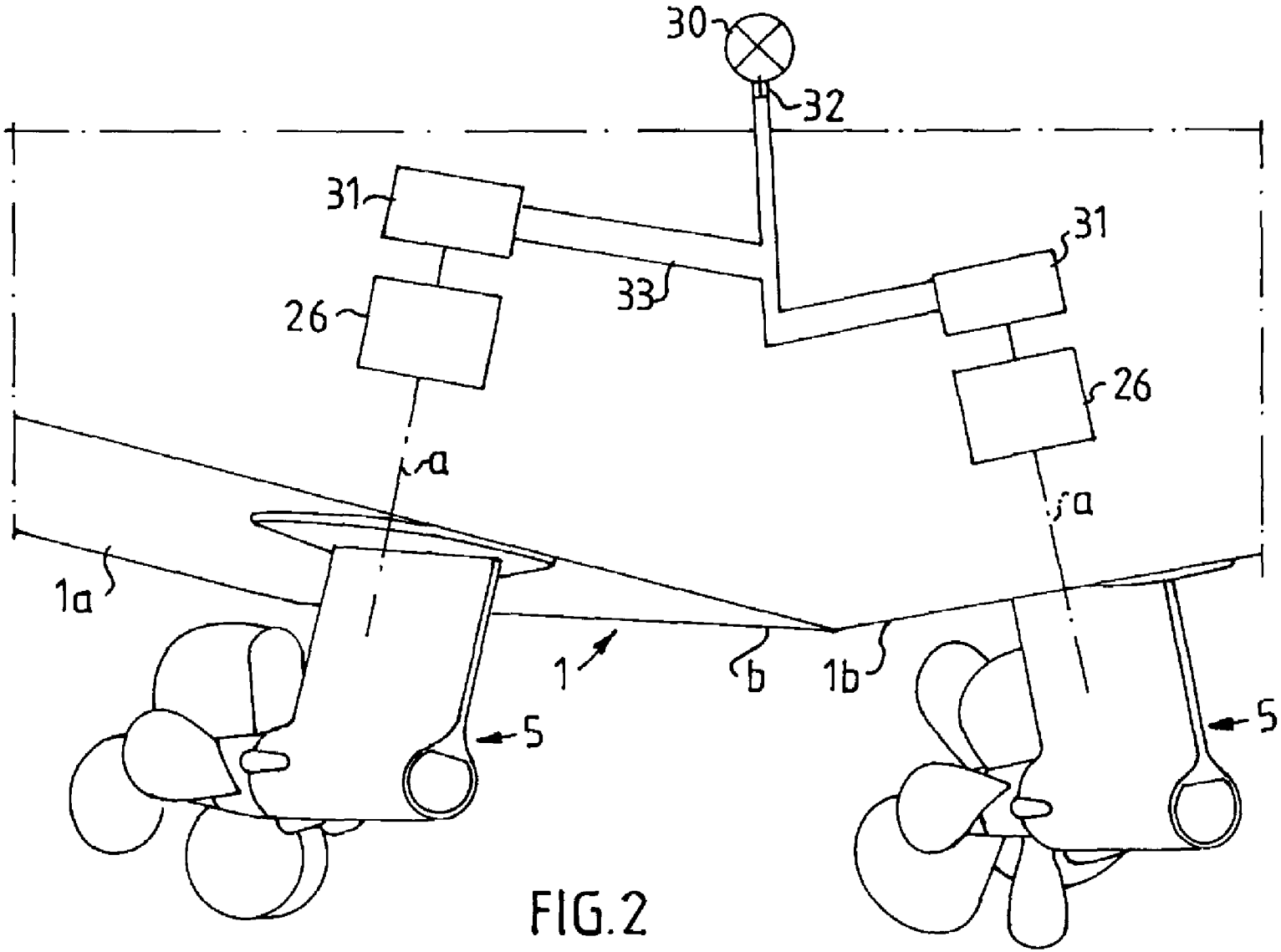
Figure 3:
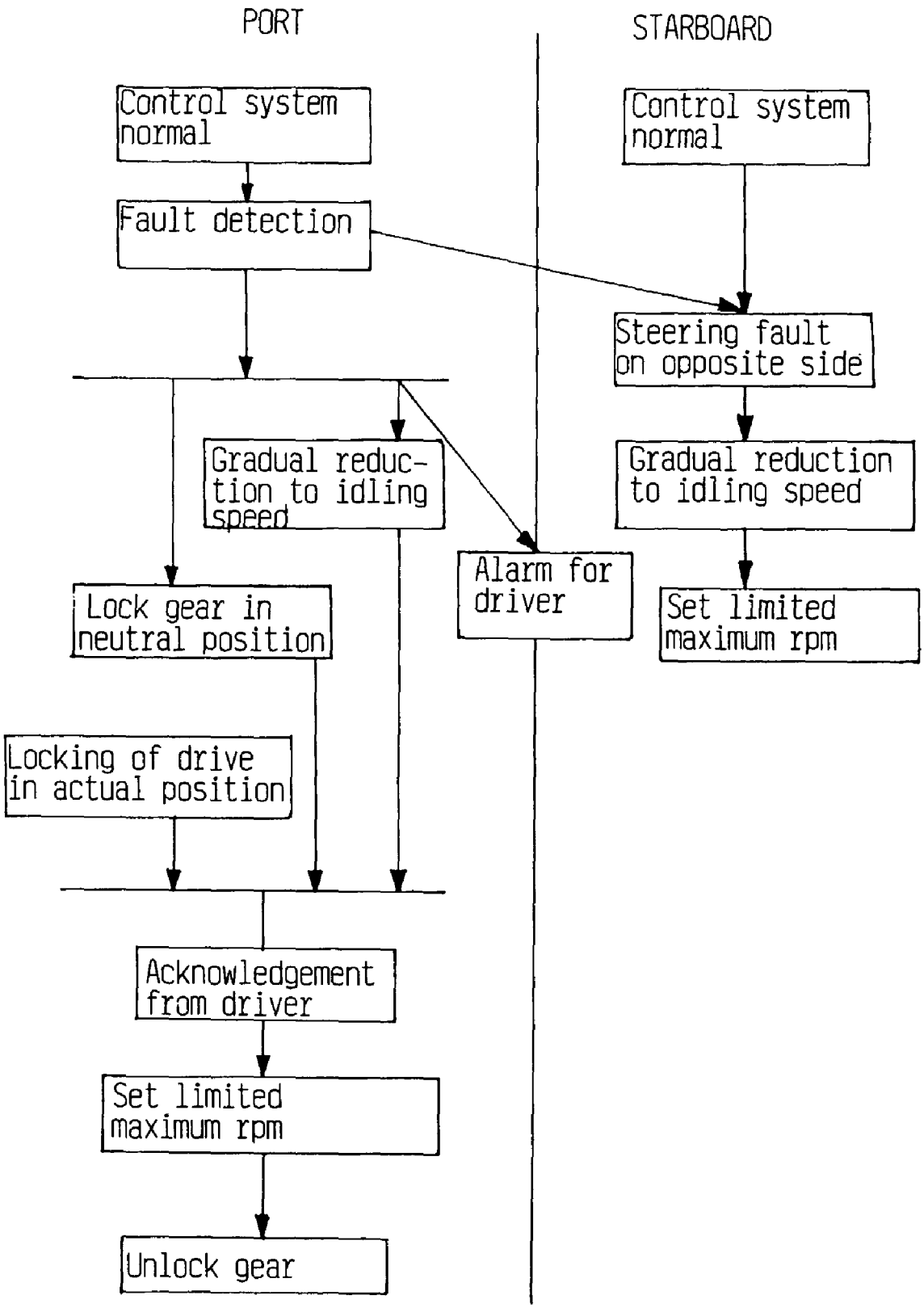

The invention is described in greater detail with reference to illustrative embodiments shown in accompanying drawings, in which FIG. 1 shows a longitudinal section through a part of a boat bottom with a diagrammatically represented steerable outboard drive and associated control electronics;

FIG. 2 shows a diagrammatic representation of the stem portion of a boat with two outboard drives of the kind shown in FIG. 1, and FIG. 3 shows a flow diagram of measures in the event of fault detection in the port control system.

In FIG. 1, reference number 1 designates the bottom of a boat hull, which can be made of moulded fibreglass-reinforced polyester plastic. The bottom of the hull is designed with an opening 2 which is surrounded by a vertical shaft 3 which extends up into the interior of the hull. The shaft is preferably moulded in one piece with the bottom 1 and is designed with an inwardly directed peripheral flange 4 which has an in the main triangular cross section in the illustrative embodiment shown.

The shaft 3 with the flange 4 forms a mounting arrangement for a propeller drive designated generally by 5 which, in the illustrative embodiment shown, has an underwater housing 6 in which two concentric propeller shafts 7 and 8, each with its respective propeller 9 and 10, are rotatably mounted. The underwater housing 6 is connected to a gear housing 11, in which a horizontal drive shaft 12 is rotatably mounted. The shaft 12 is connected drivably to the output shaft from an internal combustion engine 40. The shaft 12 drives a vertical shaft 16 via a bevel gear, which comprises conical gearwheels 13, 14 and 15, enclosed in the gear housing 11. The gearwheels 13 and 14 are mounted rotatably on the shaft 16 and are alternatively lockable on the shaft by means of a respective multiple-disc dry disc clutch 17 and 18 for driving the shaft 16 in either direction of rotation. The shaft 16 drives the propeller shafts 7 and 8 in opposite directions of rotation via a bevel gear, comprising gearwheels 19, 20 and 21, enclosed in the underwater housing. In the illustrative embodiment shown, the propellers 9 and 10 are tractor propellers arranged in front of the underwater housing 6, at the rear end of which a discharge 22 for exhaust gases opens.

The drive 5 is mounted in an opening 2 with the aid of a mounting element designated generally by 3 which grips around the flange 4 via a pair of intermediate vibration-damping and sealing elastic rings 24 and 25. The underwater housing 6 is mounted, in a way not shown in greater detail, in the gear housing 11 for rotation about a rotation or steering axis "a" which coincides with the drive shaft 16. The rotation of the underwater housing 6 is brought about with the aid of an electric servomotor 26, which can have a gearwheel, fixed on a shaft, engaging with a gear rim (not shown) connected to the underwater housing.

FIG. 2 shows the stem portion of a boat hull with a V-shaped bottom 1. Mounted in each bottom portion 1*a* and 1*b* and at the same distance from the central plane "b" of the bottom is an outboard drive 5 of the type shown in FIG. 1. The drives can be mounted in the way shown in FIG. 1. In the figures, reference number 30 designates a wheel at a steering location, and 31 an electronic control unit 31, which can comprise a computer. As shown in FIG. 2, each drive 5 has its own control unit 31, which is electrically connected to the servomotor 26 of the respective drive 5. With the aid of the servomotors 26, the underwater housings 6 of the drives can be rotated independently of one another about their rotation axis "a" depending on signals from the respective control unit 31 for steering the boat.

The wheel 30 is coordinated with a sensor 32 which senses the wheel deflection from a starting position, for example the position when driving straight ahead, and provides a signal depending on the wheel deflection to the control unit 31, which in turn provides a steering command depending on this signal to the servomotor 26. The control systems of the two drives 5 are electrically completely separate, so that, if an electrical fault occurs in the control system of one drive 5, the control system of the other drive 5 is not affected.

In order for it to be possible for the control units 31 to communicate with one another, so that information about a fault detected in the control system of one drive can be delivered to the control unit 31 of the other drive, the control units can communicate with one another via an optical link 33. Each control unit 31 also communicates with an engine control unit 34, which can comprise a computer. The engine control unit 34 controls the speed of the internal combustion engine 40 coupled to the drive and is electrically connected to a sensor 35, which is coordinated with what is known as a single-lever control 36, that is to say a combined gear and throttle control with forward, neutral and reverse position and also throttle ranges beyond forward and reverse position, and delivers a signal depending on the position of the control 36 to the engine control unit 34 and the control unit 31.

Each control unit 31 monitors continuously, when the associated engine 40 is in operation, that the actual value of the steering deflection of the underwater housing 6 corresponds to the desired value delivered by the wheel sensor 32. If the control unit 31 in the control system of one drive detects a fault (see FIG. 3), for example a power failure or that the actual value suddenly does not correspond to the desired value, the control unit 31 provides a signal to the associated engine control unit 34 to throttle down gently to idling. At the same time, the control unit provides a signal to the control unit of the other drive to throttle the other engine down to approximately half throttle, which may be roughly 1500-2000 rpm, via the associated engine control unit. The driver is warned, either by an audio signal or visually, for example in clear text on a trip computer screen, or in both ways that a fault has occurred in the control system of one drive. The control unit 31 also sends a signal to disengage and lock the gear in neutral position and to lock the underwater housing 6 of the drive in the current angular position, which can be effected either by a brake integrated in the steering servomotor unit 26 or, if there is no brake, by short-circuiting the servomotor.

In order for it to be possible to continue driving and to propel the boat with the engine of the drive locked in neutral position as well, the driver has to show that he has noted that a fault has occurred. In a preferred embodiment, the system is adapted in such a way that the locking of the gear in neutral position is cancelled when the driver moves the lever 35 from the current gear position into its neutral position. At the same time, the maximum speed of the associated engine is also limited to a maximum speed which is the same as that of the other engine, that is to say roughly 1500-2000 rpm. The driver can then engage the gear and continue driving the boat with both the engines and with the underwater housing 6 of the drive with the faulty control system locked but with the other drive fully steerable. It has been found that, with a drive installation of the type described above, approximately 70% of the maximum steering effect is obtained when steering with one drive compared with steering with both drives.

The invention claimed is:

1. Method of regulating engine speed and steering in the event of fault detection in a control system in a boat with two engines (40), which are speed-controlled by electronic engine control means (34) depending on signals from sensors (35) which are coordinated with manually operable gear and throttle controls (36), and an outboard drive (5) coupled to each engine, which has an underwater housing (36) which is rotatable relative to the hull of the boat and in which at least one propeller shaft (7,8) can be driven via an electrically operated transmission (13-18), with forward, neutral and reverse gear, arranged in a housing in the drive and the rotation of which is regulated by means of an electric servomotor (26) controlled by an electronic control unit (31) depending on signals to the control unit from a sensor (32) coordinated with manually operable steering means (30), characterized in that—in the event of detection of a fault in the control system of one drive (5) during driving—the following measures are initiated automatically by the engine and drive control electronics (34, 31):

gradual reduction of the engine speed from a speed within the higher speed range of the engine to a predetermined lower speed in at least the internal combustion engine belonging to the drive with the control system in which the fault has been detected, alarm for a driver, locking of the drive with the control system in which the fault has been detected in the current steering position, limiting of the maximum permitted engine speed to a lower speed than the maximum speed in at least the engine belonging to the drive with the control system in which the fault has been detected after acknowledgement from the driver that the fault detection has been noted.

2. Method according to claim 1, characterized in that the engine speed of the engine (40) coupled to the drive (5) with the control system in which the fault has been detected is first reduced gradually to idling speed, while the engine speed of the other engine (40) is reduced gradually to a speed higher than idling speed but lower than maximum speed.

3. Method according to claim 2, characterized in that a speed limit above idling speed but below maximum speed is set for the engine (40) coupled to the drive (5) with the control system in which the fault has been detected after acknowledgement from the driver that the fault detection has been noted.

4. Method according to claim 3, characterized in that the drive (5) with the control system in which the fault has been detected is shifted to neutral position and locked in this position and in that the locking is cancelled after acknowledgement from the driver that the fault detection has been noted.

5. Method according to claim 3, characterized in that adjustment of the said manual gear and throttle controls (36) into neutral position constitutes acknowledgement that the fault detection has been noted.

6. Method according to claim 2, characterized in that the drive (5) with the control system in which the fault has been detected is shifted to neutral position and locked in this position and in that the locking is cancelled after acknowledgement from the driver that the fault detection has been noted.

7. Method according to claim 2, characterized in that adjustment of the said manual gear and throttle controls (36) into neutral position constitutes acknowledgement that the fault detection has been noted.

8. Method according to claim 1, characterized in that the drive (5) with the control system in which the fault has been detected is shifted to neutral position and locked in this position and in that the locking is cancelled after acknowledgement from the driver that the fault detection has been noted.

9. Method according to claim 8, characterized in that adjustment of the said manual gear and throttle controls (36) into neutral position constitutes acknowledgement that the fault detection has been noted.

10. Method according to claim 1, characterized in that adjustment of the said manual gear and throttle controls (36) into neutral position constitutes acknowledgement that the fault detection has been noted.

11. Boat with a hull (1) in which an outboard drive (5) is mounted on each side of a longitudinal central plane (b) of the hull, each of which drives on the one hand is coupled to an internal combustion engine (40), which is speed controlled by electronic engine control means (34) depending on signals from sensors (35) which are coordinated with manually operable gear and throttle controls (36), and on the other hand comprises an underwater housing (6) which projects downwards from the outside of the hull and is mounted rotatably relative to the hull and in which at least one at least in the main horizontal propeller shaft (7,8) is rotatably mounted and can be driven via an electrically operated transmission (13-18), with forward, neutral and reverse gear, arranged in a housing in the drive and the rotation of which is regulated by means of a control system which comprises an electronic control unit (31) and an electric servomotor (26) which is controlled by the control unit depending on signals from a sensor (32) coordinated with manually operable steering means (30) and communicating with the control unit, characterized in that the control units (31) communicate with the engine control means (34) and are adapted so as continuously to monitor the steering function of the drives (5) and together with the engine control means—in the event of detection of a steering fault in the control system of one of the drives—to initiate gradual reduction of the speed of at least the engine (40) belonging to the drive with the control system in which the fault has been detected to a predetermined lower speed, to activate alarm means communicating with the control unit, to lock the drive with the control system in which the fault has been detected in the current steering position and, after a signal from manually operable means (36), to limit the maximum permitted speed to a lower speed than the maximum speed in at least the engine belonging to the drive with the control system in which the fault has been detected.

12. Boat according to claim 11, characterized in that the control units (31) and the engine control means (34) are arranged so as gradually to reduce the engine speed of the engine (40) coupled to the drive (5) in which the fault has been detected to idling speed and the engine speed of the other engine (40) to a speed higher than idling speed but lower than maximum speed.

13. Boat according to claim 12, characterized in that the control units (31) and the engine control means (34) are arranged so as to set a speed limit above idling speed but below maximum speed for the engine (40) coupled to the drive (5) in which the fault has been detected after a signal from the said manually operable means (36).

14. Boat according to claim 13, characterized in that the control units (31) and the engine control means (34) are arranged so as to shift the drive (5) with the control system in which the fault has been detected into neutral position, to lock the drive in this position and to cancel the locking after a signal from the said manually operable means (36).

15. Boat according to claim 13, characterized in that the said manually operable means are formed by the said manually operable gear and throttle controls (36).

16. Boat according to claim 12, characterized in that the control units (31) and the engine control means (34) are arranged so as to shift the drive (5) with the control system in which the fault has been detected into neutral position, to lock the drive in this position and to cancel the locking after a signal from the said manually operable means (36).

17. Boat according to claim 12 characterized in that the said manually operable means are formed by the said manually operable gear and throttle controls (36).

18. Boat according to claim 11, characterized in that the control units (31) and the engine control means (34) are arranged so as to shift the drive (5) with the control system in which the fault has been detected into neutral position, to lock the drive in this position and to cancel the locking after a signal from the said manually operable means (36).

19. Boat according to claim 18, characterized in that the said manually operable means are formed by the said manually operable gear and throttle controls (36).

20. Boat according to claim 11, characterized in that the said manually operable means are formed by the said manually operable gear and throttle controls (36).

* * * * *